US009816344B2

(12) United States Patent
Roselier et al.

(10) Patent No.: US 9,816,344 B2
(45) Date of Patent: Nov. 14, 2017

(54) PIPE PROVIDED WITH A CRIMPED METAL ELEMENT, AND CORRESPONDING PROCESS

(71) Applicant: Saltel Industries, Bruz (FR)

(72) Inventors: Samuel Roselier, Le Rheu (FR); Benjamin Saltel, Cintre (FR); Jean-Louis Saltel, Le Rheu (FR); Romain Neveu, Rennes (FR)

(73) Assignee: Saltel Industries (FR)

( * ) Notice: Subject to any disclaimer, the term of this patent is extended or adjusted under 35 U.S.C. 154(b) by 285 days.

(21) Appl. No.: 14/390,483

(22) PCT Filed: Mar. 22, 2013

(86) PCT No.: PCT/EP2013/056039

§ 371 (c)(1),
(2) Date: Oct. 3, 2014

(87) PCT Pub. No.: WO2013/152940

PCT Pub. Date: Oct. 17, 2013

(65) Prior Publication Data

US 2015/0075818 A1 Mar. 19, 2015

Related U.S. Application Data

(60) Provisional application No. 61/637,364, filed on Apr. 24, 2012.

(30) Foreign Application Priority Data

Apr. 13, 2012 (FR) ..... 12 53423

(51) Int. Cl.
*E21B 33/127* (2006.01)
*E21B 17/00* (2006.01)
(Continued)

(52) U.S. Cl.
CPC ..... *E21B 33/1277* (2013.01); *E21B 17/00* (2013.01); *E21B 17/1078* (2013.01); *E21B 33/10* (2013.01)

(58) Field of Classification Search
None
See application file for complete search history.

(56) References Cited

U.S. PATENT DOCUMENTS 2,864,450 A 12/1958 Burns
4,105,262 A * 8/1978 Richey ..... E21B 17/1078 175/325.2

(Continued)

FOREIGN PATENT DOCUMENTS

WO 9748268 A2 12/1997

OTHER PUBLICATIONS

International Search Report for Application No. PCT/EP2013/056039 dated Apr. 24, 2013.

*Primary Examiner* — Caroline N Butcher
(74) *Attorney, Agent, or Firm* — Lerner, David, Littenberg, Krumholz & Mentlik, LLP

(57) ABSTRACT

A pipe to be placed within a well for producing a fluid of interest includes an outer face onto which is crimped a tubular metal element.
The inner face of the tubular element exhibits an annular groove in which a metal anchoring ring or a pair of juxtaposed anchoring rings is engaged.
Each anchoring ring consists of a ring split transversely at least partially, is provided on its inner face with projecting anchoring members, and exhibits, in cross-section, a base equipped with the projecting members and at least one flank forming an acute angle with the base.
The annular groove exhibits a profile that is substantially complementary to that of the ring(s).
(Continued)

The depth of the groove is less than the thickness of the ring or of the rings.
The projecting members are at least partially embedded into the pipe after crimping of the metal element onto the pipe.

20 Claims, 8 Drawing Sheets

(51) Int. Cl.
*E21B 17/10* (2006.01)
*E21B 33/10* (2006.01)

(56) References Cited

U.S. PATENT DOCUMENTS

| | | | | |
|---|---|---|---|---|
| 5,031,695 | A * | 7/1991 | Cain | E21B 33/0422 166/208 |
| 5,205,356 | A | 4/1993 | Bridges et al. | |
| 6,513,600 | B2 | 2/2003 | Ross | |
| 6,662,868 | B1 * | 12/2003 | Van Bilderbeek | E21B 33/038 166/88.2 |
| 2004/0226714 | A1 * | 11/2004 | Rogers | E21B 17/1028 166/241.2 |
| 2009/0211770 | A1 * | 8/2009 | Nutley | E21B 33/1208 166/387 |
| 2011/0095526 | A1 | 4/2011 | Vanderford et al. | |
| 2011/0284206 | A1 * | 11/2011 | Nguyen | E21B 33/038 166/75.11 |
| 2012/0067597 | A1 * | 3/2012 | Lang | E21B 33/12 166/387 |
| 2012/0205111 | A1 * | 8/2012 | Udipi | E21B 43/26 166/308.1 |

* cited by examiner

PIPE PROVIDED WITH A CRIMPED METAL ELEMENT, AND CORRESPONDING PROCESS

CROSS REFERENCE TO RELATED APPLICATIONS

The present application is a national phase entry under 35 U.S.C. §371 OF International Application No. PCT/EP2013/056039, filed Mar. 22, 2013, published in English, which claims priority from French Patent Application No. 1253423, filed Apr. 13, 2012 and U.S. Provisional Patent Application No. 61/637,364, filed Apr. 24, 2012, the disclosures of which are incorporated by reference herein.

The present invention is situated within the field of well drilling.

It relates more particularly to metal tubing designed to be placed within a well producing a fluid of interest.

This invention applies especially but not exclusively to the casing of a horizontal well. This casing is called "pipe" in the remainder of the document.

This well configuration has become widespread over recent years due to novel extraction techniques.

A horizontal well, inter alia, considerably increases the productive length and therefore the contact surface with the geological formation in which gas and/or oil is present in source rock.

In such a horizontal configuration, it is technically difficult to case and cement the annular space between the pipe and the inner wall of the well in a horizontal position. This cementing technique, used in the majority of vertical or slightly deviated wells, provides a seal between different geological zones.

The exploitation of horizontal wells, whether for stimulation or flow control, requires some zones to be isolated in the rock formation itself.

A pipe is run into the well with isolation devices at its periphery, spaced out in a predetermined fashion.

The term "zonal isolation packers" is used for these devices. Between these isolation devices the pipe often has ports open or closed on demand, which enable communication between the pipe and the isolated zone of the well.

In this horizontal completion environment, hydraulic fracturing (also called "fracking") is a technique for cracking of the rock in which the pipe is set horizontally.

Fracking is carried out by injection of a liquid under pressure. This technique enables extraction of oil or gas contained in highly compact and impermeable rocks.

FIG. 1 is a simplified section view of a pipe which lies within a previously prepared well.

The description of this figure is simply for the purpose of explaining how pipes provided with such zonal isolation packers have been used up until now.

A well A, the wall whereof is labeled A1, was previously dug in the ground S.

Within this well, a pipe 1 has been placed which is partially shown here.

Along its wall this pipe has, at pre-determined intervals, isolation devices 2. Here only two devices 2, labeled N and N−1, are shown, solely for the sake of simplicity.

In practice, there exist a greater and very large number of such devices along the pipe. In known fashion, each device consists of a tubular metal sleeve 20, the opposite ends whereof are firmly bonded, directly or indirectly, to the outer face of the pipe by reinforcing rings or skirts 6.

A pressure P0 prevails within the well.

Originally, the metal sleeves 20, when not expanded, were substantially aligned with the rings 6.

The distal end of the pipe preferably has a port, not shown, which is initially open during the running phase of the pipe into the well so as to allow circulation of fluid from upstream to downstream at pressure P0. This port is preferably plugged by means of a ball which is dropped in the pipe and plugs this port, which allows the pressure inside the pipe to be increased.

A first fluid under pressure P1 greater than P0 is then sent into the pipe and this is introduced through openings 10 facing the sleeves 20 over the entire pipe so as to cause the metal sleeves to expand and to take up the position of FIG. 1 wherein their central intermediate portion is pressed against the wall A1 of the well.

Of course, the material of the sleeve and the pressure are selected so that the metal deforms beyond its elastic limit.

A device, not shown, makes it possible to free an opening located at the distal end of the pipe when the pressure P1 is slightly increased. The pressure at the opening changes from P1 to P0 and circulation is then possible within the pipe from upstream to downstream in the well.

Thereafter, another ball 5 is sent into the pipe and seats in a sliding seat 4 substantially halfway between the two isolation devices N and N−1.

Originally, the seat 4 is located exactly facing the aforementioned openings 3 and blocks them. Under the influence of the ball's motion, the seat 4 is blocked and moves, thus freeing the openings 3. A fracturing fluid under very high pressure is then injected into the pipe.

This fluid, under pressure P2, is introduced into the device as well as into the annular space B separating the devices.

However, the pressure prevailing inside the device N−1 returns to the initial well pressure, which is to pressure P0.

The attachment of the aforementioned sleeves, and more generally of any equipment, to the wall of the pipe 1 is particularly important.

For example, during fracturing operations sometimes carried out and more than 1,000 bars (15,000 psi), the axial forces exerted in on a zonal isolation packer can reach over 100 tons. These forces are simply due to the pressure applied within the annular space B defined by the outside of the pipe 1 and the inner wall of the well A.

Pipes are often sized, qualified and certified for well conditions. The diameter, the mass per unit length and the material are defined by the operator according to the internal and external pressure values, the flow rate, the temperature, the presence of a corrosive agent, etc.

It is then preferable to use pipes of the same kind over the entire length of the completion, rather than to insert a segment of different manufacture.

Now the use of standard pipes imposes several constraints, particularly if the attachment must be made fluid or gas-tight.

In the first place, the pipes are often made by rolling, so that the geometric tolerances and surface quality do not allow, for instance, the use of fluid or gas-tight seals.

Machining the pipe over its entire length can then be considered, in order to correct shape and surface quality flaws. However, besides its cost, such an operation would invalidate the qualification of the pipe.

A second option for fluid or gas-tight attachment of metal systems onto the outside of pipes consists of using welding.

Now the materials used for pipes can have very different chemical compositions (L80, P110 . . . ). It is therefore difficult to use welding, the mechanical strength whereof is extremely dependent on the nature of the materials.

The stresses generated by welding in the pipe would also impose its requalification, that is to say the implementation of long and burdensome new tests.

In the event that the attachment need not be fluid or gas-tight, it is possible to drill blind radial holes in the pipe, and then insert a screw (or the equivalent) into them.

This situation is shown in FIG. 2, wherein this screw is labeled 7.

This method requires machining of the basic pipe 1 and therefore probably its requalification. In addition, in order to be able to resist a considerable axial load F, the use of several screws is indispensable. All the screws must then bear on the pipe at the same time in order to maximize the axial load carried, which requires accurate and costly machining operations.

In WO-97/48268, US-2011/095526 and U.S. Pat. No. 5,205,356 are described devices in which a partially slit ring is used. All these systems require also at least a screw.

The invention has as its object to offset these disadvantages.

The proposed system uses a standard pipe which surface may have been cleaned and/or polished, without removing any metal. These operations, which are only superficial, do not invalidate the initial qualification of the pipes.

Thus, the present invention relates to a metal pipe designed to be placed within a well for producing a fluid of interest, a pipe on the outer surface whereof is crimped a tubular metal element, characterized by the fact that:

- the inner face of said tubular element exhibits an annular groove wherein is engaged a metal anchoring ring, or a pair of anchoring rings back-to-back;
- each anchoring ring consists of a ring at least partially slit transversely, is provided on its inner face with projecting anchoring members and exhibits, in cross-section, a base provided with said projecting members and at least one flank making an acute angle with said base;
- the annular groove has a profile that is substantially complementary to that of the ring or to the pair of rings;
- the depth of the groove being less than the thickness of the ring or rings;

so that said projecting members are at least partially engaged into said pipe after crimping of the metal element onto the pipe.

An expandable sleeve structure is known from document U.S. Pat. No. 6,513,600, the outer face whereof is provided with at least one ring which is conformed, when the sleeve is expanded, in such a way that it anchors itself in the wall of the well.

The present invention takes up this anchoring technique, but in another application context and assigning it different functions.

According to other non-limiting and advantageous characteristics of the invention:

- a single ring is engaged in the groove and has a transverse slit; further, this ring includes a second flank, and the two flanks meet in such a way that the ring assumes, in cross-section the general shape of a triangle;
- a single ring is engaged in the groove and includes a transverse slit; further, this ring includes a second flank, and the two flanks are separated from one another by a face substantially parallel to said base, in such a way that the ring assumes, in cross-section, the general shape of a trapezoid;
- said acute angles are equal, such that said ring assumes, in section, a symmetrical shape;
- two rings are set back-to-back and they include several partial transverse slits;
- the ring or the pair of rings have at their periphery a profile constituting a sealing means using metal-to-metal contact;
- said profile has the shape of a letter "C";
- said profile has the shape of a lip that can be at least partially deformed;
- said projecting members consist of a series of parallel circumferential ribs separated by complementary shaped grooves so that the ensemble assumes, seen in cross-section, the form of a succession of crenellations of triangular section;
- said inner face of the ring or of the pair of rings exhibits at least one groove with an axis parallel to that of the ring, this groove separating said members into different segments;
- the inner face of said tubular element exhibits at least one additional groove wherein is engaged an O-ring seal;
- said projecting members consist of a tiling of teeth of pyramidal shape;
- at least one anti-extrusion ring is also engaged in said additional groove;
- said tubular element is firmly bound to the end of at least one expandable tubular metal sleeve.

Another aspect of the invention relates to a process for fastening a tubular element on the outer face of a pipe, in which:

- the inner face of said tubular element exhibits an annular groove wherein is engaged a metal anchoring ring or a pair of anchoring rings set back-to-back;
- each anchoring ring consists of a ring at least partially slit transversely, is provided on its inner face with projecting anchoring members, and exhibits, in cross-section, a base provided with said projecting members and at least one flank forming an acute angle with said base;
- the annular groove exhibits a profile that is substantially complementary to that of the ring or of the pair of rings;
- the depth of the groove being less than the thickness of the ring or of the rings;

characterized in that said tubular element is crimped on said pipe, so that the diameters of said element and of said ring decrease and said projecting members engage in said pipe.

Other features and advantages of the present invention will appear upon reading the description of a preferred embodiment that follows.

Figure 6:
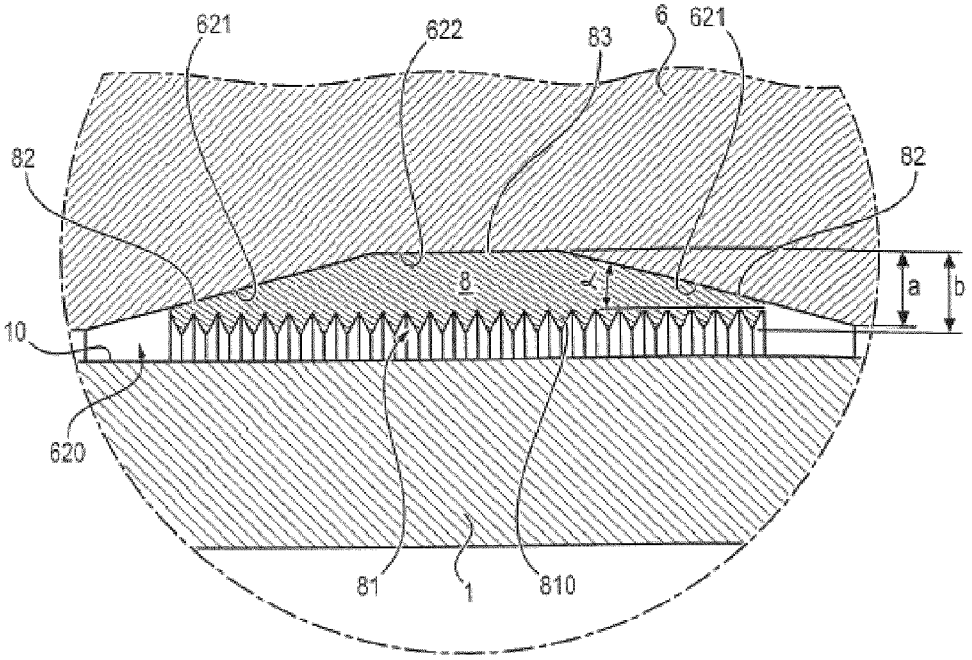
FIGS. 6 and 7 are section and extreme close-up views of the ring mentioned above, in place in a groove of an element to be crimped, respectively before and after the crimping operation.
Figure 7:
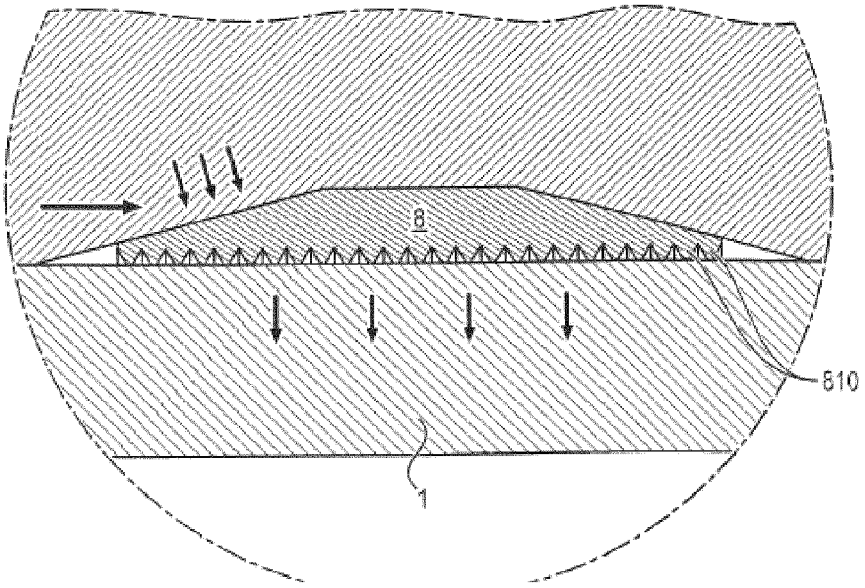
Figure 9:
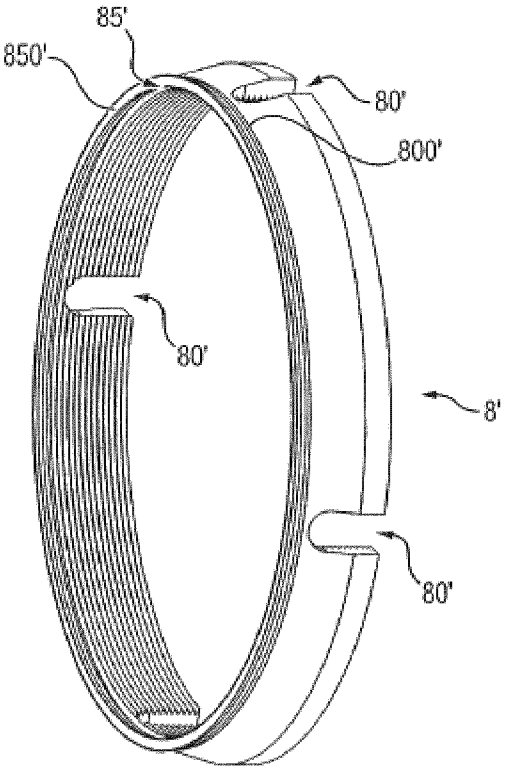
FIGS. 8 and 9 show in perspective, from opposite directions, an additional embodiment of a ring usable within the scope of the present invention.
Figure 8:
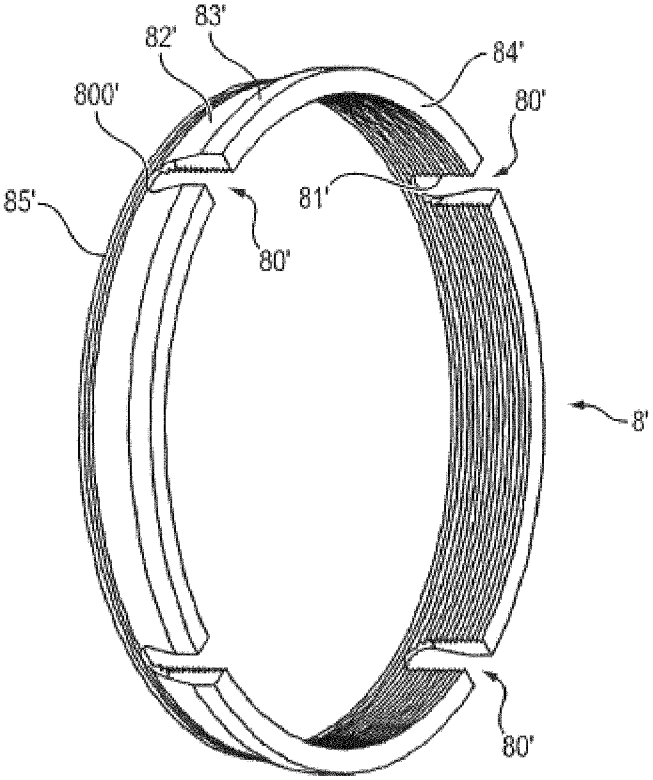
Figure 10:
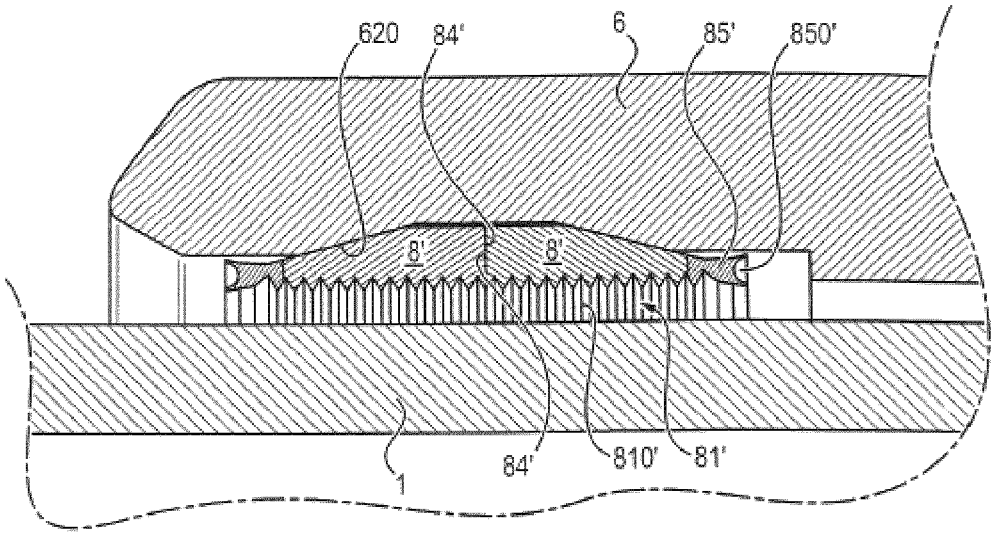
Figure 11:
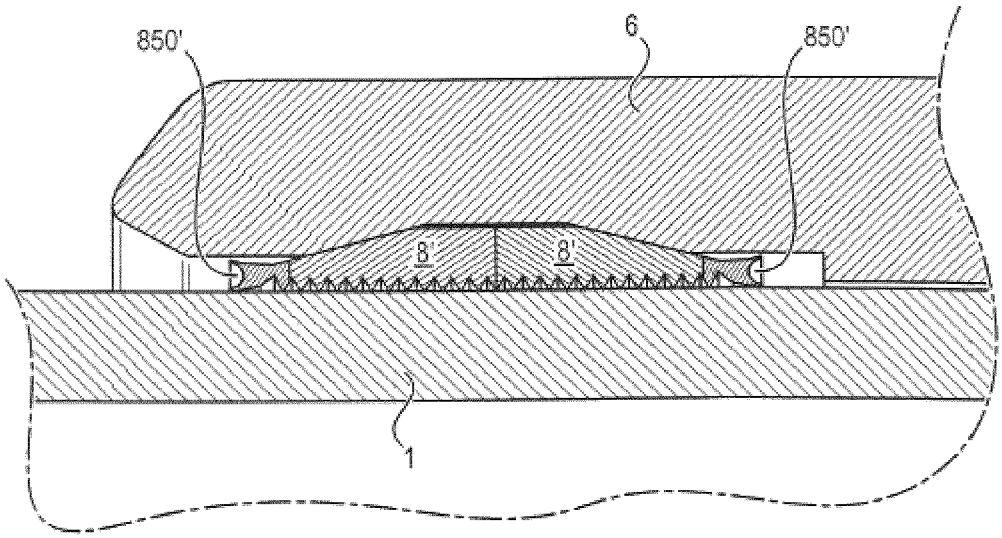
Figure 12:
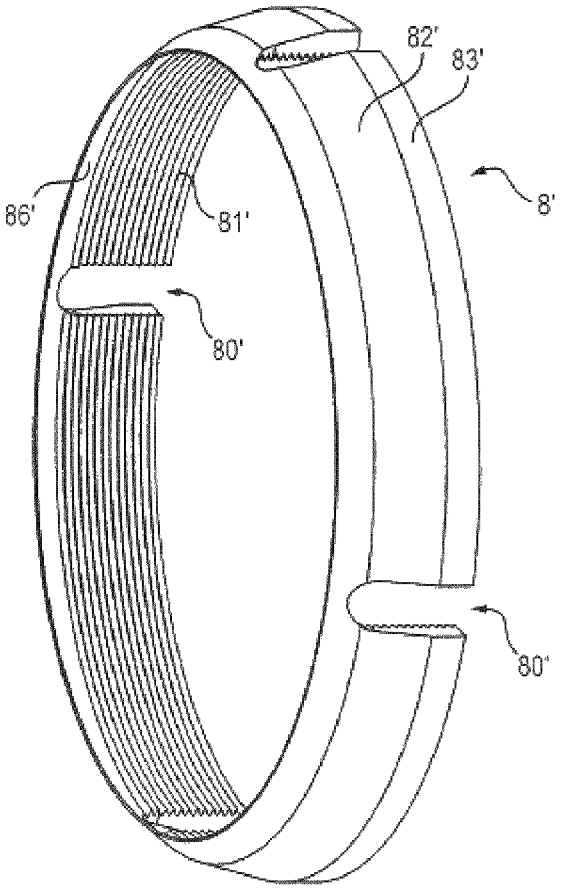
Figure 13:
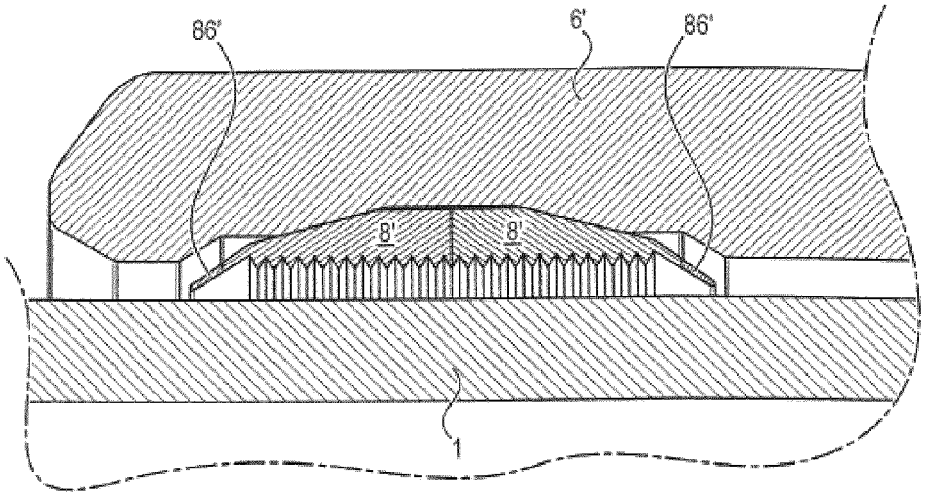
Figure 14:
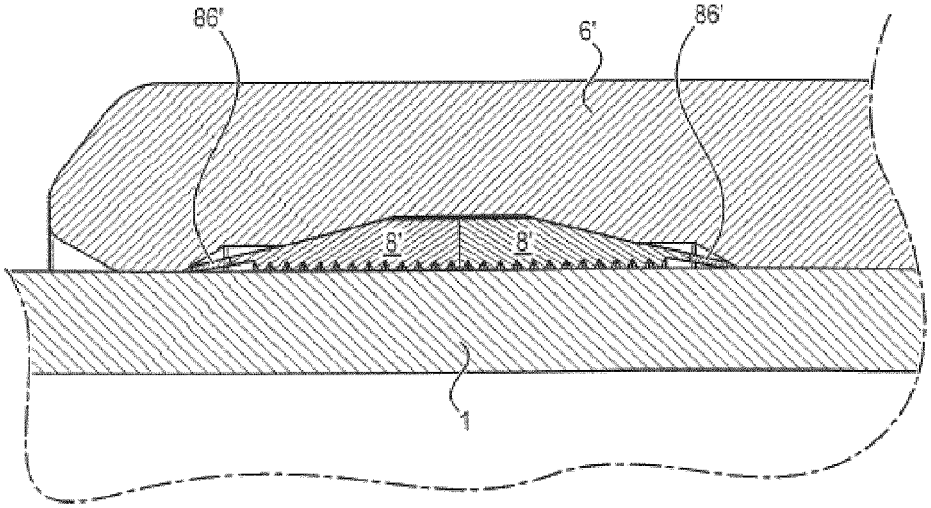

FIGS. 10 and 11 are views similar to FIGS. 6 and 7, two rings like that represented in FIGS. 8 and 9 being used;

FIG. 12 shows, also in perspective, another embodiment of said ring;

FIGS. 13 and 14 are views similar to FIGS. 10 and 11, two rings like that shown in FIG. 12 being used.

Figure 1:
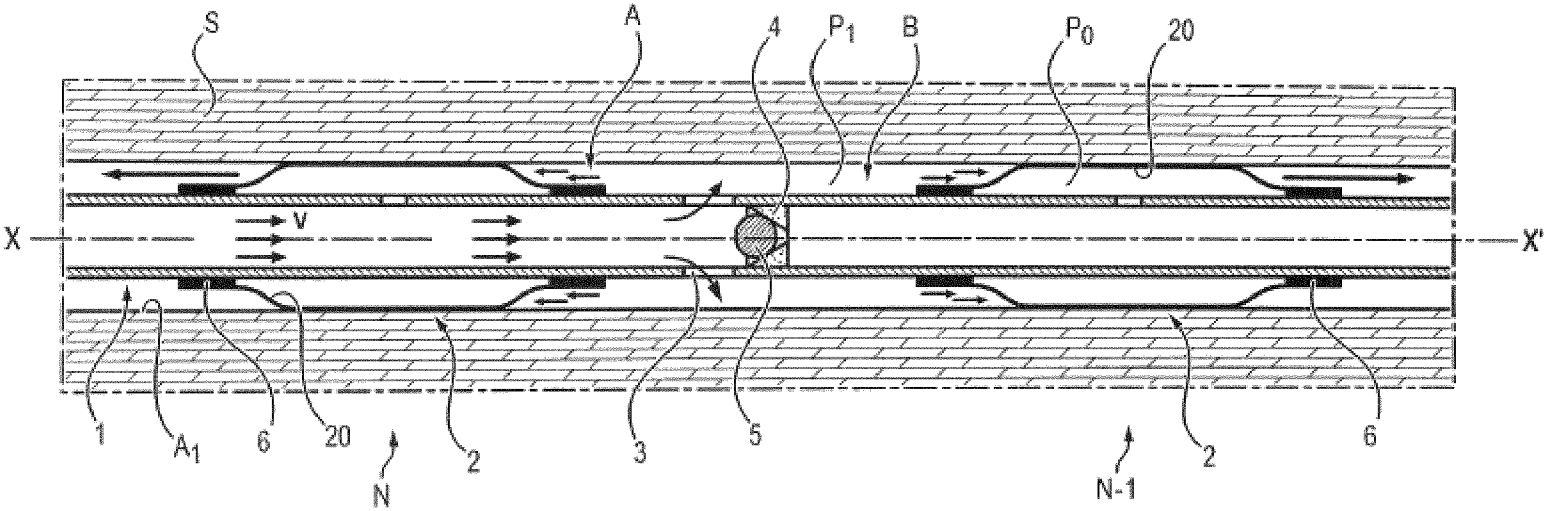
FIG. 1 is, as seen above, a schematic representation of a portion of a well equipped with a pipe with zonal isolation packers.
Figure 2:
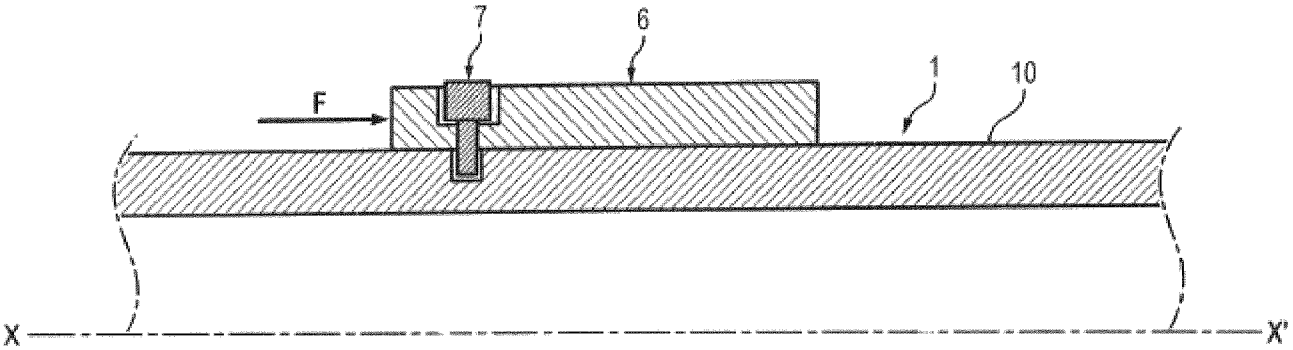
FIG. 2 is a section view of a portion of a pipe equipped with a tubular element which is attached to it by screws.
Figure 3:
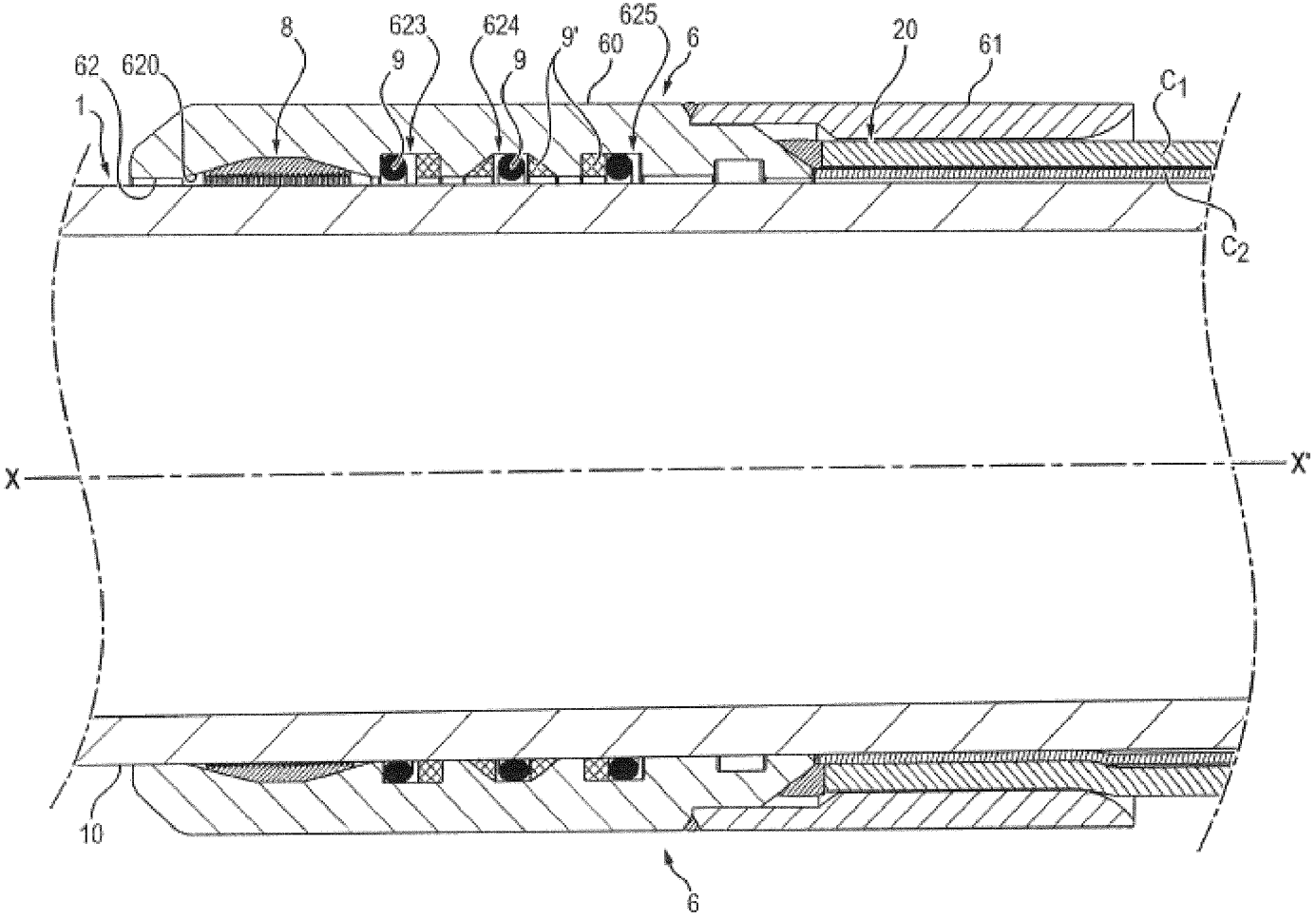
FIG. 3 is a partial section view of a pipe conforming to the invention, the upper portion showing the tubular element before crimping, while the lower portion shows it after crimping.

When referring to FIG. 3, the presence of a pipe 1 is noted, which is a production tubing designed to be set within a well A.

The pipe allows the production of a fluid of interest.

According to the invention, it is proposed to crimp, onto the outer face 10 of the pipe 1, a tubular element 6 which, in the present case, constitutes an element for retaining and attaching to the pipe 1 two expandable annular sleeves labeled $C_1$ and $C_2$. In one embodiment, not shown, the tubular element 6 could constitute, for example, a stop or one end of a swellable packer made of elastomer.

This element 6, having a generally known shape and structure, includes a main body 60 which is followed by a skirt 61 partially covering the ends of the sleeves $C_1$ and $C_2$.

In conformity with one feature of the invention, the inner face 62 of the tubular element 6 includes an annular groove 620 particularly visible in the upper portion of FIG. 3, wherein is engaged a metal anchoring ring 8.

It will be noted that the ductility of the pipe 1 can be greater than that of the ring 8, or not.

Figure 4:
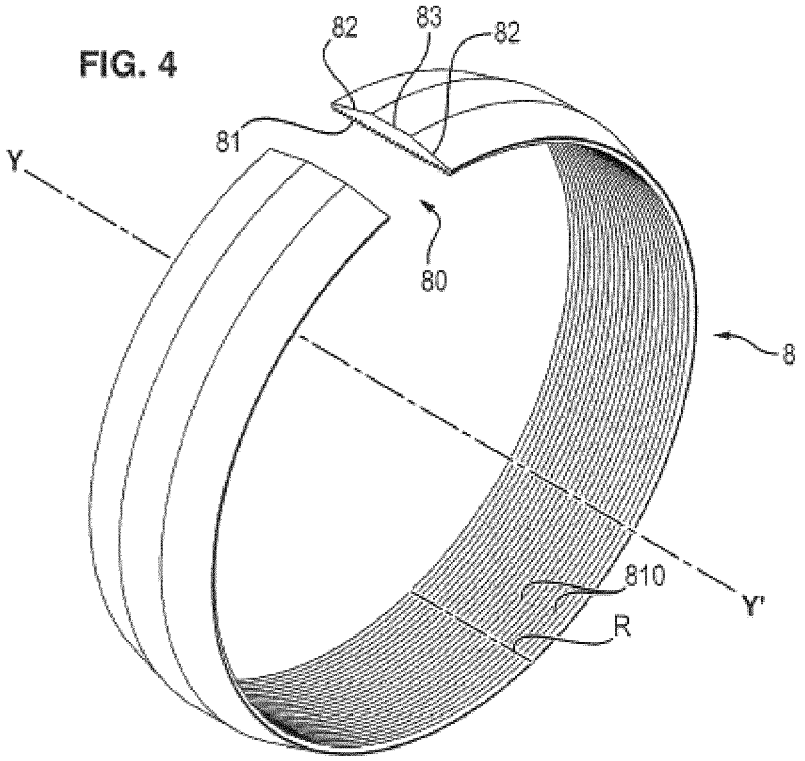
FIGS. 4 and 5 are views of a sealing ring which is part of the device according to the invention, shown before and after crimping, respectively.
Figure 5:
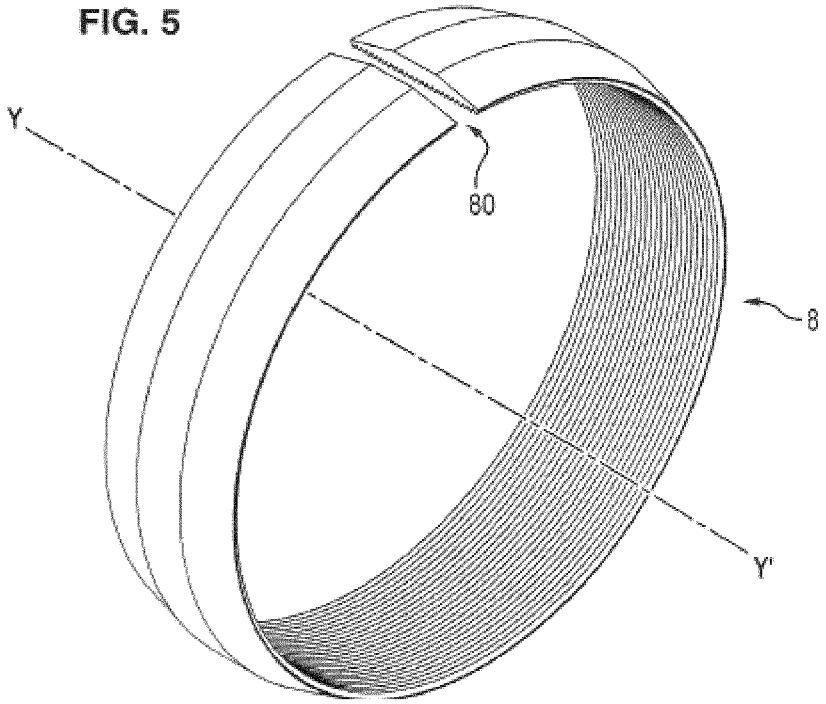

As is particularly visible in FIGS. 4 and 5, the anchoring ring 8 consists of a transversely slit ring. This slit is labeled 80. The ring is provided on its inner face with projecting anchoring members 810.

In the embodiment shown here, the projecting members consist of a series of parallel and circumferential ribs, separated by grooves of complementary shape, such that the ensemble assumes, seen in cross-section, the shape of a succession of crenellations of triangular section.

Of course, other forms of projecting members can be contemplated.

As shown in FIG. 4, one or more groove(s) R with an axis parallel to the parallel axis Y-Y' of the ring can separate the projecting members into different segments.

In another embodiment, also not shown, the projecting members can consist of a tiling of teeth, having a pyramidal shape for example.

Referring more particularly to FIG. 6, it is observed that according to its cross-section, the ring 8 has a base or inner face 81 provided with said projecting members 810, which connects with two faces 82 each forming an acute angle $\alpha$ with that base.

By way of indication, the value of the angle $\alpha$ is on the order of 10°.

In the embodiment described here, the flanks 82 are separated one from the other by a face 83 substantially parallel to the base 81 such that it assumes, in cross-section, the general shape of a trapezoid.

Here the two angles $\alpha$ are equal, so that the ring assumes, in section, a symmetrical shape. As will be seen further on, this symmetrical shape allows forces in opposing directions to be carried.

However, in one variation, these angles could be different.

In the particular case where two flanks of the ring join, what is involved is an anchoring ring which, in cross-section, has the shape of a triangle.

As shown more particularly in FIGS. 6 and 7, the annular groove 620 which receives the ring has a profile that is substantially complementary to that of this ring.

In this instance, what is involved here is a groove with two flanks 621 and a bottom 622.

Another feature of the invention is that the depth of the groove 620, labeled a in FIG. 6, is slightly less than the thickness b of the ring.

Referring to FIG. 3, it is observed that the tube 6 exhibits, in addition to the groove 620, other grooves labeled here 623, 624 and 625.

These three grooves are optional. When they are present, they can be more than or less than three in number, as shown here.

Within these grooves, O-rings 9 are accommodated as well as anti-extrusion rings 9'.

During the operation of crimping the tubular element 6 onto the pipe 1, the inner diameter of this element 6 is decreased. The same is true of the ring 8, the diameter whereof decreases by virtue of the edges of the slit 80 coming together. Simultaneously with this phenomenon, due to the crimping force which is essentially radial, the teeth 810 of the ring partially enter into the pipe 1, as shown in FIG. 7.

This is explained by the difference between the aforementioned values a and b and the projecting and pointed shape of the members 810.

As shown by the arrows in FIG. 7, any axial or other displacement is then prevented by wedge effect, the flanks 621 and the bottom 622 of the annular groove constituting stops for the ring 6. More particularly, the slope of the flanks 621 transmits forces to the teeth of the anchoring ring.

The ring 6 therefore makes it possible to obtain effective attachment of the two parts and is virtually insensitive to pressure variations.

The sealing gaskets 9 which occupy the additional grooves allow further improvement in the fluid or gas-tightness of the assembly. Thus, the crimping provides at the same time the initial compression of the compression seals that is indispensable for making them fulfill their role as sealing means.

The sealing gaskets 9 can, for example, be made of elastomer (for example O-rings, lip seals, etc) or of metal ("C-ring" type).

Such a system can operate with considerable internal and external pressures, and it is then possible for an extrusion clearance, that is a tiny opening between the crimped element 6 and the pipe 1, to appear and to increase during operation, by elastic deflection of the parts.

To compensate for this drawback, anti-extrusion rings 9' are used which have a sloping wall and which are made of substantially deformable material.

When pressure is applied to one side of the seal 9, the latter presses on one or the other of the rings 9' which then move axially slightly and plug the extrusion clearance.

In the embodiment shown in FIGS. 8 and 9, the ring 8', which is of the same general type as that described above, includes a series of partial slits 80' which extend transversely. Here they are four in number and diametrically opposed, two by two.

In one embodiment, not shown, the number of partial slits could be greater.

These are partial slits which do not continue through to the opposite side of the ring, so that there is a continuation of material, which is labeled 800', aligned with these slits 80'.

Their function will be explained further on.

Considered transversely, this ring 8' has a base or inner face 81' provided with projecting members 810' of the same type as those described above.

Furthermore, it has an upper face 83', generally parallel to the base or inner face 81'.

Unlike the embodiment already described, this ring 8' has a single sloping face 82' which forms an acute angle with the base 81'.

The other face, labeled 84, is straight and oriented perpendicularly to the faces 81' and 83'.

Furthermore, in continuation of the face 82' extends a flange 85', whereof the free end has a "C" shaped profile 850'.

In other words, this profile 850' has a concave shape.

As shown more particularly in FIGS. 10 and 11, the groove 620 that equips the tubular element 6 receives not one, but two rings 8'.

In this embodiment, two identical rings are involved which are set back-to-back and in contact at their faces 84'.

Their placement is made possible by the presence of partial slits 80' which allow the rings a certain ability to deform.

In these FIGS. 10 and 11, the rings are shown in cross-section at the aforementioned slits 80'. Thus, the presence of the flange 85' is observed on either side of the groove 620.

During the crimping operation already seen with reference to the foregoing embodiment, the teeth of the rings penetrate into the material of the pipe, while the flange 85', due to its arched "C" shape, contributes to the formation of a metal-to-metal seal between the two parts 1 and 6.

The embodiment of FIG. 12 is distinguished from the foregoing one solely by the fact that the inclined face 82' is extended by a very thin lip 86'.

Due to this fact, as is shown by comparing FIGS. 13 and 14, during the crimping operation, the region of the lip 86' deforms elastically in such a way that it achieves here too a metal-to-metal seal.

The invention claimed is:

1. A pipe system designed to be placed within a well for producing a fluid of interest, comprising:

a pipe having an outer face;

a tubular metal element having inner and outer faces and being crimped on the outer face of the pipe, the inner face of said tubular element exhibiting an annular groove;

a metal anchoring ring or a pair of juxtaposed anchoring rings engaged in the annular groove of the tubular metal element;

wherein:

each anchoring ring consists of a ring at least partially slit transversely and is provided on its inner face with projecting anchoring members, and exhibits, in cross-section, a base provided with said projecting anchoring members and at least one flank forming an acute angle ($\alpha$) with said base;

the annular groove exhibits a profile that is substantially complementary to a profile of an outer face of the anchoring ring or of the pair of anchoring rings;

said tubular metal element is in one piece; and a depth (a) of the annular groove is less than a thickness (b) of the anchoring ring or of the anchoring rings;

so that said projecting anchoring members are at least partially engaged in said pipe after crimping of the tubular metal element onto the pipe.

2. The pipe system according to claim 1, wherein the metal anchoring ring is engaged in said groove and which includes a transverse slit constituting an interruption in the material, and wherein said ring has a second flank and that the two flanks join, so that the ring assumes, in cross-section, the general shape of a triangle.

3. The pipe system according to claim 2, wherein said at least one flank includes at least two flanks having acute angles ($\alpha$) that are equal, such that said ring assumes, in section a symmetrical shape.

4. The pipe system according to claim 1, wherein the metal anchoring ring is engaged in said groove and which includes a transverse slit constituting an interruption in the material, wherein said ring has a second flank, and that the two flanks are separated from one another by a face that is substantially parallel to said base such that the ring assumes, in cross-section, the general shape of a trapezoid.

5. The pipe system according to claim 1, which the pair of juxtaposed anchoring rings includes several partial transverse slits.

6. The pipe system according to claim 1, wherein the ring or the pair of rings exhibits, on their periphery a profile constituting sealing means by metal-to-metal contact.

7. The pipe system according to claim 6, wherein said profile is "C" shaped.

8. The pipe system according to claim 6, wherein said profile has the form of a lip that is at least partially deformable.

9. The pipe system according to claim 1, wherein said projecting anchoring members consist of a series of parallel circumferential ribs, separated by grooves, such that the ensemble assumes, seen in cross-section, the form of a succession of crenellations of triangular section.

10. The pipe system according to claim 9, wherein said inner face of the ring or of the pair of rings exhibits at least one groove with an axis parallel to that of the ring, this groove separating said projecting anchoring members into different segments.

11. The pipe system according to claim 1, wherein the inner face of said tubular element exhibits at least one additional groove wherein is engaged a sealing gasket the initial compression whereof is provided by crimping the tubular element onto the pipe.

12. The pipe system according to claim 11, wherein at least one anti-extrusion ring is also engaged in said additional groove.

13. The pipe system according to claim 1, wherein said projecting anchoring members consist of a tiling of teeth of pyramidal shape.

14. The pipe system according to claim 1, wherein said tubular element is firmly bound to the end of at least one expandable tubular metal sleeve.

15. A process for fastening a pipe system, comprising:

crimping a tubular element on an outer face of a pipe;

wherein an inner face of said tubular element exhibits an annular groove wherein is engaged a metal anchoring ring or a pair of juxtaposed metal anchoring rings;

wherein each anchoring ring consists of a ring at least partially slit transversely and is provided on its inner face with projecting anchoring members, and exhibits, in cross-section, a base provided with said projecting anchoring members and at least one flank forming an acute angle ($\alpha$) with said base;

wherein the annular groove exhibits a profile that is substantially complementary to a profile of an outer face of the anchoring ring or of the pair of anchoring rings, wherein:

wherein said tubular metal element is in one piece;

wherein a depth (a) of the annular groove is less than a thickness (b) of the anchoring ring or of the anchoring rings; and wherein the step of crimping causes the diameters of said element and of said anchoring ring or of said anchoring rings to decrease and said projecting anchoring members to engage in said pipe.

16. The process according to claim 15, wherein the metal anchoring ring is engaged in said groove and which includes a transverse slit constituting an interruption in the material, and wherein the step of crimping causes edges of the slit to move toward one another.

17. The pipe system according to claim 1, wherein after crimping of the tubular metal element onto the pipe, the diameters of said element and of said anchoring ring or of said anchoring rings decrease.

18. The pipe system according to claim 1, wherein the metal anchoring ring is engaged in said groove and which includes a transverse slit constituting an interruption in the material, and wherein after crimping of the tubular metal element onto the pipe, edges of the slit move toward one another.

19. A pipe system designed to be placed within a well for producing a fluid of interest, comprising:

a pipe having an outer face;

a tubular metal element having inner and outer faces and being crimped on the outer face of the pipe, the inner face of said tubular element exhibiting an annular groove;

a pair of juxtaposed anchoring rings engaged in the annular groove of the tubular metal element;

wherein:

each anchoring ring consists of a ring partially slit transversely and is provided on its inner face with projecting anchoring members, and exhibits, in cross-section, a base provided with said projecting anchoring members and a flank forming an acute angle ($\alpha$) with said base;

the annular groove exhibits a profile that is substantially complementary to a profile of an outer face of the pair of anchoring rings;

said tubular metal element is in one piece; and a depth (a) of the annular groove is less than a thickness (b) of the anchoring rings;

so that said projecting anchoring members are at least partially engaged in said pipe after crimping of the tubular metal element onto the pipe.

20. The pipe system according to claim 19, wherein the pair of juxtaposed anchoring rings are in contact with one another.

* * * * *